US006361341B1

(12) United States Patent
Okayasu et al.

(10) Patent No.: US 6,361,341 B1
(45) Date of Patent: Mar. 26, 2002

(54) CONNECTOR HOUSING FOR A WATERTIGHT CONNECTOR AND A WATERTIGHT CONNECTOR

(75) Inventors: Yasushi Okayasu; Hitoshi Okumura, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/589,411

(22) Filed: Jun. 7, 2000

(30) Foreign Application Priority Data

Jul. 6, 1999 (JP) ..... 11-160072
Jul. 6, 1999 (JP) ..... 11-160073

(51) Int. Cl.[7] ..... H01R 13/52

(52) U.S. Cl. ..... 439/271; 439/274; 439/587; 439/595

(58) Field of Search ..... 439/271, 272, 439/274, 275, 279, 283, 281, 586, 587, 588, 589, 733.1, 595

(56) References Cited

U.S. PATENT DOCUMENTS 3,571,779 A * 3/1971 Collier ..... 439/271
3,922,477 A * 11/1975 Glowacz ..... 439/271
4,349,241 A * 9/1982 Juris et al. ..... 439/281
4,479,691 A * 10/1984 Smith, Jr. ..... 439/595
4,780,091 A * 10/1988 Shenton ..... 439/272
4,824,390 A * 4/1989 Crane et al. ..... 439/283
4,875,870 A 10/1989 Hardy et al. ..... 439/936
4,998,896 A * 3/1991 Lundergan ..... 439/274
5,151,045 A * 9/1992 Cravens et al. ..... 439/271
5,382,174 A 1/1995 Kinoshita ..... 439/271
5,735,702 A * 4/1998 Hio ..... 439/271

FOREIGN PATENT DOCUMENTS

JP 4-132178 * 5/1992 ..... 439/271
JP 9-134756 5/1997

* cited by examiner

*Primary Examiner*—Tho D. Ta
(74) *Attorney, Agent, or Firm*—Anthony J. Casella; Gerald K. Hespos

(57) ABSTRACT

A connector is provided to achieve individual water protection while reducing connection force without complicating the construction of housings. The connector includes female housing 10 with an inner housing 11 formed with cavities 14 into which female terminal fittings 2 are insertable and an outer housing 12 accommodating the inner housing 11. A male housing 40 is provided with a smaller receptacle 42 into which the inner housing 11 is fittable, and male terminal fittings 44 are mounted to project into the smaller receptacle 42. A second gelatinous material 46 is mounted on a back surface 42A of the smaller receptacle 42 in advance while being penetrated by the male terminal fittings 44. As the housings 10, 40 are connected, the second gelatinous material 46 is compressed between the back surface 42A of the smaller receptacle 42 and a front surface 11A of the inner housing 11, thereby providing water protection between the housings 10, 40 and between the respective cavities 14 of the inner housing 11.

15 Claims, 11 Drawing Sheets

CONNECTOR HOUSING FOR A WATERTIGHT CONNECTOR AND A WATERTIGHT CONNECTOR

BACKGROUND OF THE INVENTION

1. Field of the Invention

The present invention relates to a watertight electrical connector that ahieves an individual water-protecting function.

2. Description of the Related Art

The prior art watertight connector includes a rubber plug at a rear side of a terminal fitting to prevent the entrance of water into each cavity and a seal ring on engaging circumferential surfaces of male and female connector housings. However, the prior art connector may be used in an environment where the ends of wires drawn from the connector are exposed to water. In this situation, water may move along the wires due to a capillary action, and may enter the cavities to short-circuit adjacent terminal fittings. Thus, it is necessary to provide sealing between the respective cavities to provide a so-called individual water protection.

A prior art watertight connector with an individual water-protecting function is disclosed in Japanese Unexamined Patent Publication No. 9-134756. This connector is comprised of a female housing and a male housing. The male housing includes a receptacle into which the female housing may be fit. The front ends of cavities formed in the female housing are separated to define clearances between the cavities. The connector further includes a rubber seal that covers the front ends of all cavities and fills the clearances. Insertion portions project from the back surface of the receptacle for insertion into grooves formed in the front surfaces of the seal that are filled in the clearances.

The insertion of the female housing into the receptacle of the above-described male housing squeezes the outer peripheral portion of the seal between the cavities and the receptacle to provide sealing between the housings. Further, the insertion portions widen the grooves and press the portions of the seal that had been filled in the clearances around the individual cavities. Hence, sealing between the respective cavities is achieved.

The prior art watertight connector requires the seal to have a complicated shape. Furthermore, the front ends of the respective cavities of the female housing have to be formed in a separated manner, and the insertion portions need to project from the back surface of the receptacle in the male housing. As a result, the connector housings have complicated constructions. Further, the outer circumferential surface of the seal contacts substantially the entire inner circumferential surface of the receptacle of the male housing, and a contact resistance is created between the insertion portions and the grooves. Thus, a large a large frictional resistance exists during the connection of the housings, and a large force is needed to complete the connection. This leads to a problem of poor operability.

U.S. Pat. No. 4,875,870 discloses an article for protecting a connector that has a plurality of conductors. The article comprises a container, a base and a layer of gel, and is mountable on a side of a connector housing opposite the mating side. The layer of gel is arranged in the container, and is pierced by terminal fittings in cavities of the connector. The gel is compressed between the container and the base, and accordingly seals the terminal fittings at the back of the connector housing. However, the terminal fittings are inserted into the layer of gel in an intermediate portion thereof. Thus, the gel layer allows water to pass from one cavity to the neighboring cavity, and consequently the gel layer does not perform its sealing function well.

The present invention was developed in view of the above problems, and an object of invention is to provide an individual water-protecting function while reducing a connection force and without complicating the construction of housings.

SUMMARY OF THE INVENTION

The subject invention is directed to a watertight connector that has a housing with a plurality of cavities for accommodating a corresponding plurality of terminal fittings. The connector further includes at least one seal on a mating surface of the connector housing. Thus, the seal will be compressed between the mating surface and an opposed surface of a mating connector housing upon connection of the two connector housings with each other. Contrary to the gel layer of U.S. Pat. No. 4,875,870, the seal of the subject invention is on the mating side of the connector and not on a side opposite to the mating side. Accordingly, the sealing function of the connector housing is improved.

According to a preferred embodiment of the invention, the terminal fittings are pierced through the seal before the connector housing is connected with the mating connector housing.

The invention also is directed to a watertight connector comprising a first or female connector housing formed with a plurality of cavities that accommodate first or female terminal fittings. The connector further comprises a second or male connector housing with a receptacle into which the first connector housing can be fit. Second or male terminal fittings are accommodated in the second connector housing and project into the receptacle. The second terminal fittings can be connected with the respective first terminal fittings. At least one seal is compressed between a back surface of the receptacle and an opposed front surface of the first connector housing. The seal preferably is formed of a gelatinous material.

The invention also is directed to a watertight connector that has a female connector housing with a plurality of cavities that accommodate female terminal fittings. The connector further includes a male connector housing provided with a receptacle into which the female connector housing can be fit. Male terminal fittings are accommodated in the male connector housing and project into the receptacle. The male terminal fittings are configured to connect with the respective female terminal fittings when the female connector housing is inserted into the receptacle.

A gelatinous material is disposed between a back surface of the receptacle and an opposed front surface of the female connector housing. When the housings are connected, the seal or gelatinous material is compressed between the back surface of the receptacle and the front surface of the female connector housing to provide water protection between the housings and between the respective cavities.

The above described water protection can be realized merely by providing the gelatinous material between the back surface of the receptacle and the front surface of the female connector housing without complicating the construction of the connector housings. The subject invention enables a reduction of the required connection force because only a slight force is required to compress the gelatinous material at the final stage of connection of the connector housings.

A lever with a cam may be mounted pivotally on one of the connector housings and a follower that can be engaged with the cam may be provided on the other of the connector housings. Thus, the lever may be pivoted to assist in the connection of the connector housings. Since the gelatinous material is compressed using an operative force of the lever, the connector housings can be connected with a smaller force.

The seal or gelatinous material may be mounted on the back surface of the receptacle in advance while being penetrated by the second or male terminal fittings. Additionally, the second or male terminal fittings preferably are formed with hooks for hooking the seal or gelatinous material to prevent the seal or gelatinous material from coming out of the receptacle. Thus, the hooks are particularly useful when the gelatinous material is mounted on the back surface of the receptacle of the male connector housing in advance.

According to a further aspect of the invention, the seal can be compressed to between 30% and 70% of its longitudinal extension, and preferably to substantially 50% thereof.

The first connector housing may comprise an outer housing and an inner housing, and the inner housing may be arranged at least partly in a receptacle of the outer housing. The seal may be arranged between the front surface of the inner housing and the back surface of the receptacle of the second connector housing.

A second seal may be arranged in an accommodation space defined between a rear surface of the inner housing and a rear wall of the outer housing. The second seal preferably is made of a gelatinous material. Accordingly, sealing properties of the connector can be further improved.

Still further, preferably, the second seal is not compressed substantially, when the inner and outer housings are in a partial lock position. However, the seal is compressed between the rear surface of the inner housing and the rear wall of the outer housing when the inner and outer housings are in a full locked position. Additionally, the second seal preferably is penetrated by the first terminal fittings when the inner and outer housings in the partial lock position.

According to a further preferred embodiment, the seal individually seals the plurality of cavities with respect to each other upon being compressed between the first and second connector housings. Accordingly, the second terminal fittings are easily insertable into the second seal member.

These and other objects, features and advantages of the present invention will become apparent upon a reading of the following detailed description and accompanying drawings.

DETAILED DESCRIPTION OF THE PREFERRED EMBODIMENTS

Figure 1:
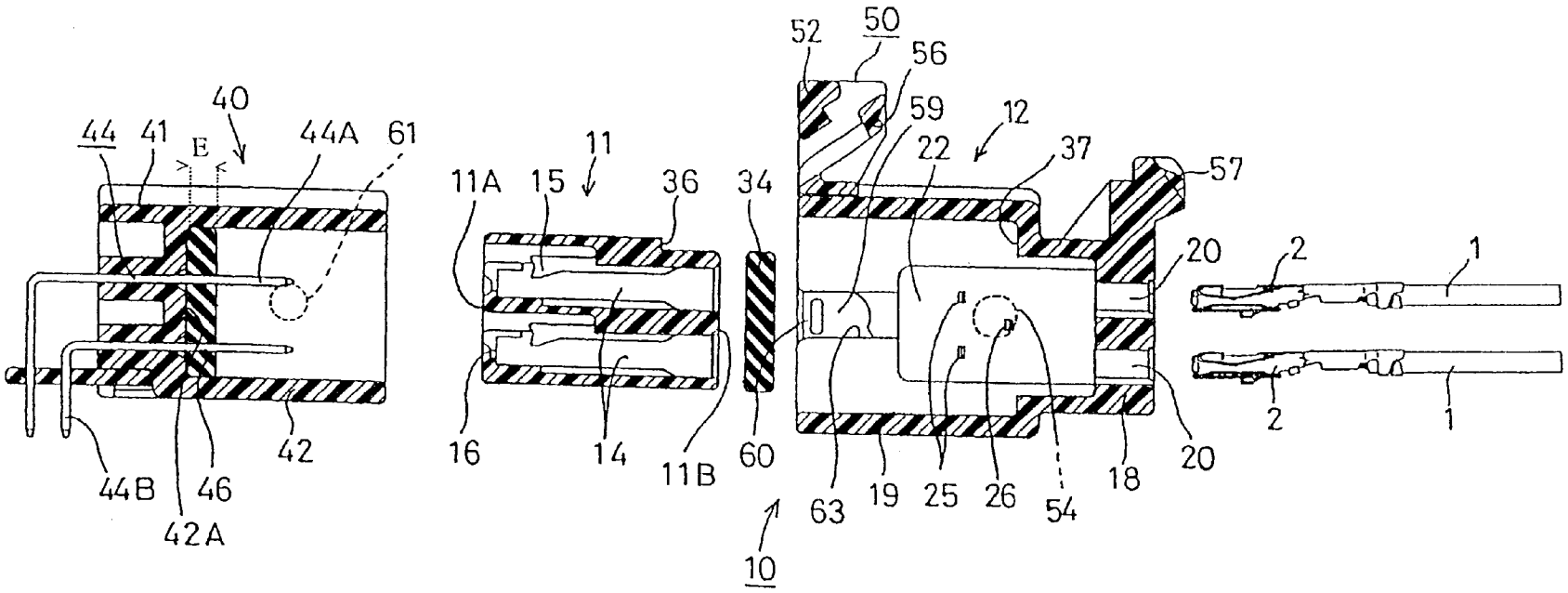
FIG. 1 is an exploded vertical section entirely showing a first embodiment of the invention.

A first embodiment of the invention is described with reference to FIGS. 1 to 10. This embodiment is comprised of a female connector housing 10 (hereinafter, "female housing") and a male connector housing 40 (hereinafter, "male housing)" that are connectable with each other. This embodiment further comprises two gelatinous materials or seals 34, 46, as shown in FIG. 1. In the description below, sides of the housings 10 and 40 that are to be connected or mated are referred to as the front.

Figure 2:
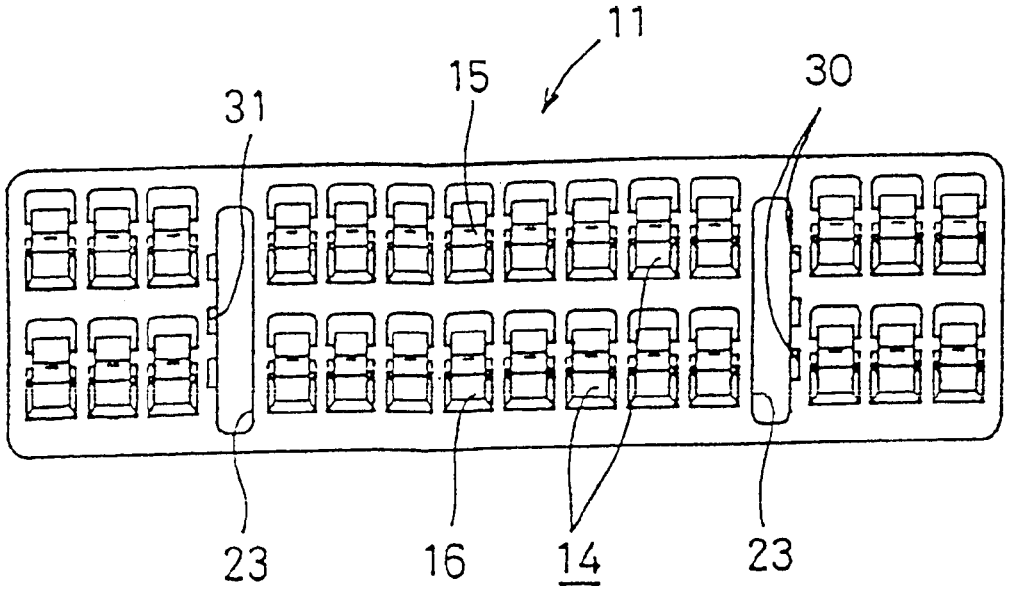
FIG. 2 is a front view of an inner housing.

The female housing 10 is divided into an inner housing 11 and an outer housing 12. The inner housing 11 preferably is substantially in the form of a wide block, as shown in FIG. 2. A plurality of cavities 14 are arranged at upper and lower stages in the inner housing 11, and are dimensioned to receive female terminal fittings 2 that have been secured to ends of wires 1. A locking portion 15 is formed on the ceiling surface of each cavity 14, and is configured for locking one of the female terminals that has been inserted into the cavity 14. Additionally, a terminal insertion opening 16 is formed at the front of each cavity 14, and is dimensioned to receive a mating second or male terminal fitting 44.

The outer housing 12 has a thick rear wall 18 and a stepped substantially rectangular large receptacle 19 that projects forwardly from the rear wall 18. A rear section of the stepped large receptacle 19 is dimensioned to receive a rear end of the inner housing 11. Insertion openings 20 are formed in the rear wall 18 of the inner outer housing 12, and communicate with the interior of the receptacle 19. The openings 20 are dimensioned to receive the female terminal fittings 2, and are formed in positions that correspond to the respective cavities 14 of the inner housing 11.

Figure 3:
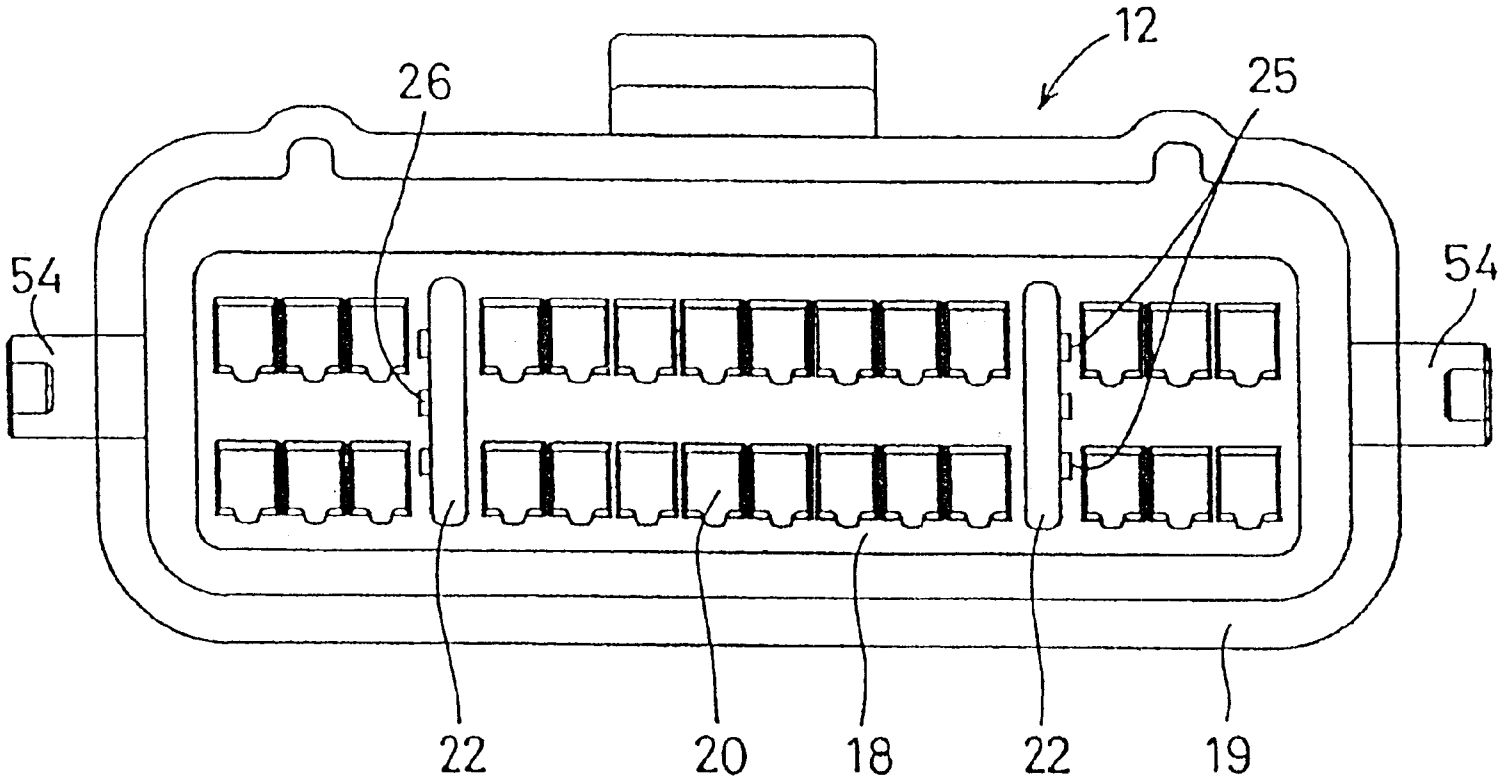
FIG. 3 is a front view of an outer housing.

A pair of substantially parallel guide plates 22 project from the inner surface of the real wall 18 of the outer housing 12, as shown in FIGS. 1 and 3. Additionally, two guide holes 23 penetrate through the inner housing 11 along forward/backward directions as shown in FIG. 2. The guide holes 23 are dimensioned and disposed to receive at least parts of the respective guide plates 22. More particularly, the guide holes 23 have a width slightly larger than the thickness of the guide plates 22. Consequently, the outer surfaces of the respective guide plates 22 can be held in sliding contact with the outer wall surfaces of the guide holes 23 and the leading ends of the guide plates 22 are elastically deformable inward in the guide holes 23.

Two vertically spaced locking projections 25 are formed on the lateral or outer surface of each guide plate 22. The locking projections 25 have tapered front surfaces, and are formed in positions toward the front end of the guide plate 22. Additionally, one full locking projection 26 with a tapered front surface is formed in behind the two partial locking projections 25 by a specified distance.

Three insertion grooves 28, 29 extend along forward/backward directions in the outer wall surfaces of the guide holes 23. The upper and lower insertion grooves 28 are formed with partial locking protuberances 30 at intermediate positions along their respective lengths. Each partial locking protuberance 30 is formed with a tapered rear surface. The middle insertion grooves 29 also are formed with full locking protuberances 31 that have tapered rear surfaces. The full locking protuberances 30 are at locations rearward of the partial locking protuberances 30. As a result, the partial locking projections 25 can be inserted in the upper and lower insertion grooves 28 and the full locking projections 26 can be inserted into the middle insertion grooves 29. At a first insertion position, the partial locking projection will engage the partial locking protuberances 30. At a further insertion position, the full locking projections 26 will engage the full locking protuberances 31.

More specifically, when the inner housing 11 is inserted into the large receptacle 19 of the outer housing 12, the guide plates 22 enter the guide holes 23. After sufficient insertion, the partial locking projections 25 move onto the partial locking protuberances 30, pass them, and are elastically engaged with the front surfaces of the partial locking protuberances 30. As a result, the inner housing 11 is locked in its partly locked position shown in FIG. 8. At this time, an accommodation space 33 with a specified depth is defined between a rear surface 11B of the inner housing 11 and the rear wall 18 of the outer housing 12. A seal or first gelatinous material 34, preferably substantially in the form of a plate, can be accommodated at least partly in the accommodation space 33. At this stage of insertion, the seal 34 is held substantially in close contact with the surrounding walls of the accommodation space in its natural state with no force acting thereon. The gelatinous or elastic material of the seal 34 may be a gel or elastic or rubbery material containing three-dimensional cross-linked molecular formations or a material that behaves as if it contained such molecular formations (geloids). For example, such a gel could be a silicone gel or resin. Another suitable gel comprises a block copolymer having relatively hard blocks (e.g. hydrogenated rubber blocks). Examples of such copolymers include styrene-diene block copolymers (linear or radial), for example styrene-butadiene or styrene-isoprene diblock or triblock copolymers, or styrene-ethylene-butylene-styrenes triblock copolymers. The gel may be formed from a single liquid material which becomes a gel when subjected e.g. to radiation or chemicals. Alternatively, the gel may be formed from two components, which become a gel when mixed, or the gel may be a composition which is a gel at working temperature, e.g. room temperature. Additionally or alternatively a gel material as disclosed in U.S. Pat. No. 4,875,870 may be used.

Figure 10:
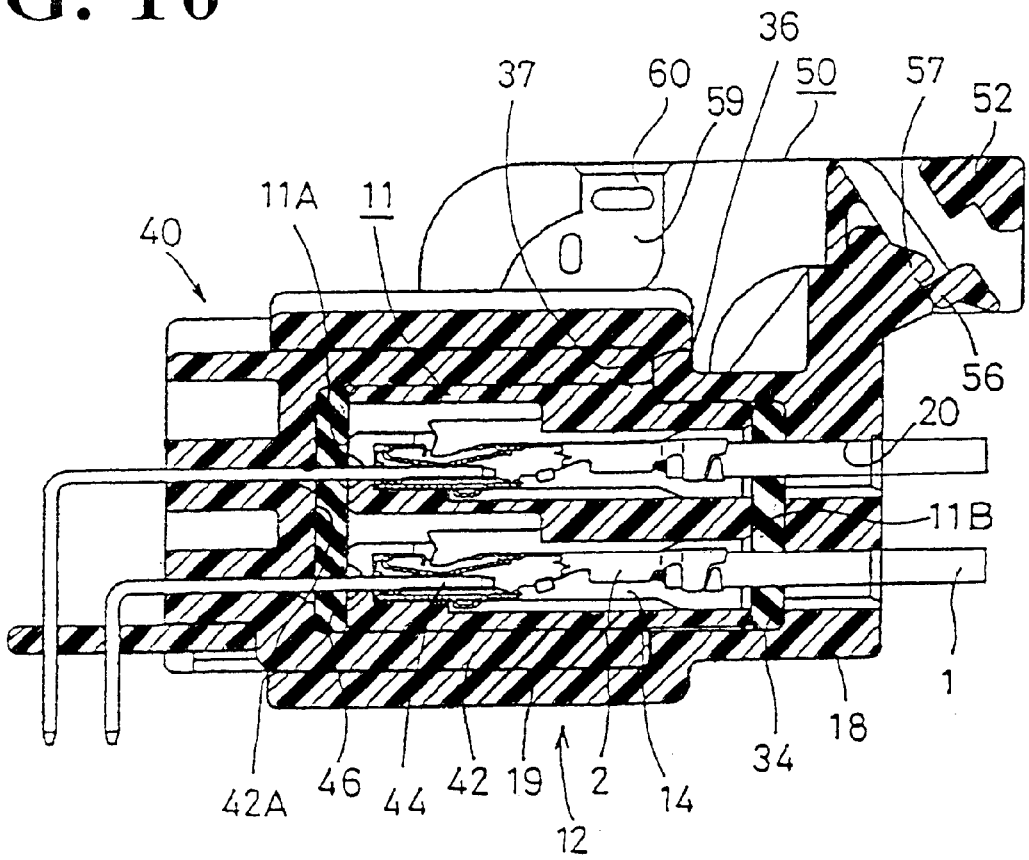
FIG. 10 is a vertical section of the male and female housings after connection.

The inner housing 11 can be pushed further from the partly locked position to a position where a locking step 36 on the upper surface of the inner housing 11 substantially contacts a stepped portion 37 of the large receptacle 19. Simultaneously, the full locking projections 26 pass the full locking protuberances 31 and are engaged elastically with the front surfaces of the full locking protuberances 31 to lock the inner housing 11 in a fully locked position in the large receptacle 19, as shown in FIG. 10. When the inner housing 11 reaches the fully locked position, the depth of the accommodation space 33 is reduced substantially to the half of its initial depth.

Figure 5:
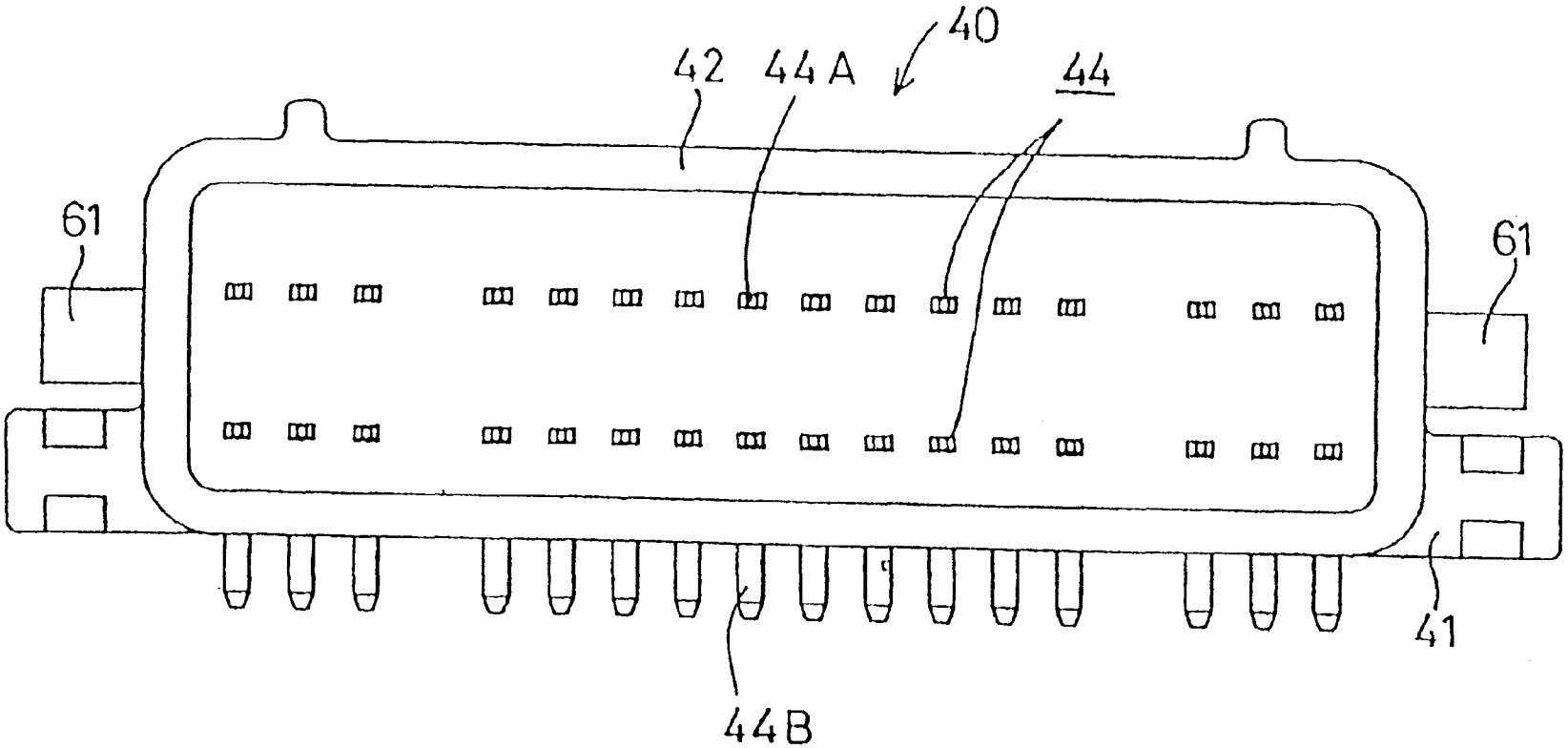
FIG. 5 is a front view of a male housing.

The male housing 40 may be mounted on a printed circuit board, and has a base portion 41 and a small receptacle 42 that projects forwardly from the base portion 41, as shown in FIGS. 1 and 5. The inner housing 11 of the female housing 10 can be fit at least partly into the small receptacle 42 while being held in close contact therewith, and the small receptacle 42 can be fit at least partly into the large receptacle 19 while being held in close contact therewith.

The male terminal fittings 44 preferably are in the form of substantially L-shaped tabs, and are at least partly mounted in the male housing 40. Horizontal portions 44A of the respective male terminal fittings 44 are arranged in two stages and project into positions in the small receptacle 42 that correspond to the respective female terminal fittings 2. Vertical portions 44B of the male terminal fittings 44 hang down in two lines displaced along forward/backward directions behind the rear surface of the base portion 41, and are connected with corresponding contacts on the printed circuit board.

As described in detail below, a specified space is defined between a back surface 42A of the small receptacle 42 and a front surface 11A of the inner housing 11 when the male and female housings are connected properly with one another and when the inner housing 11 has reached the fully locked position in the female housing 10. A second seal, which preferably is a flat plate of gelatinous material 46, is mounted in advance on the back surface 42A of the small receptacle 42 of the male housing 40. The thickness or longitudinal extension E of the second gelatinous material 46, in its natural state, is preferably about twice the corresponding dimension of the final space between the back surface 42A of the smaller receptacle 42 and the front surface 11A of the inner housing 11.

Figure 4:
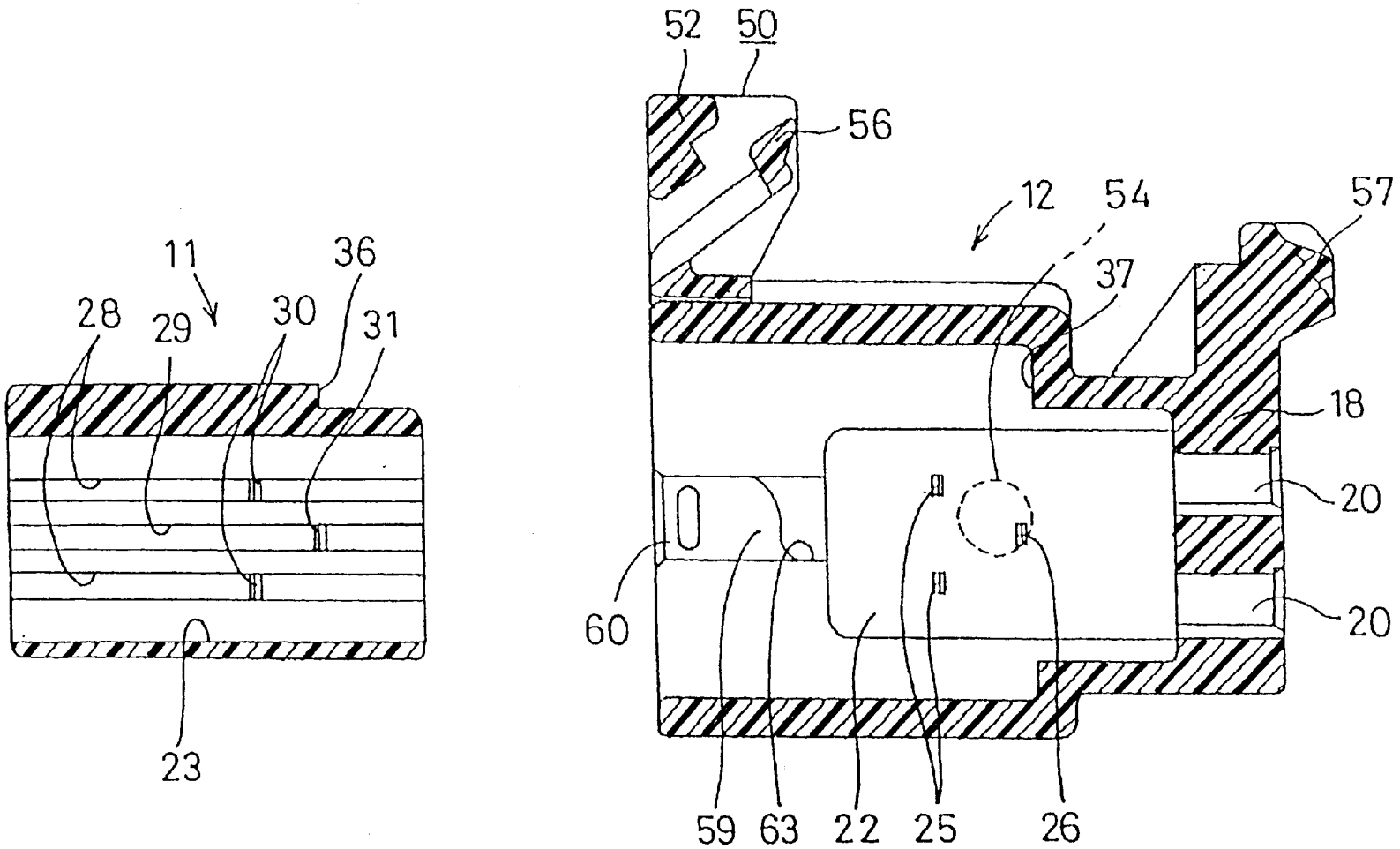
FIG. 4 is a vertical section showing a locking construction for the outer and inner housings.
Figure 6:
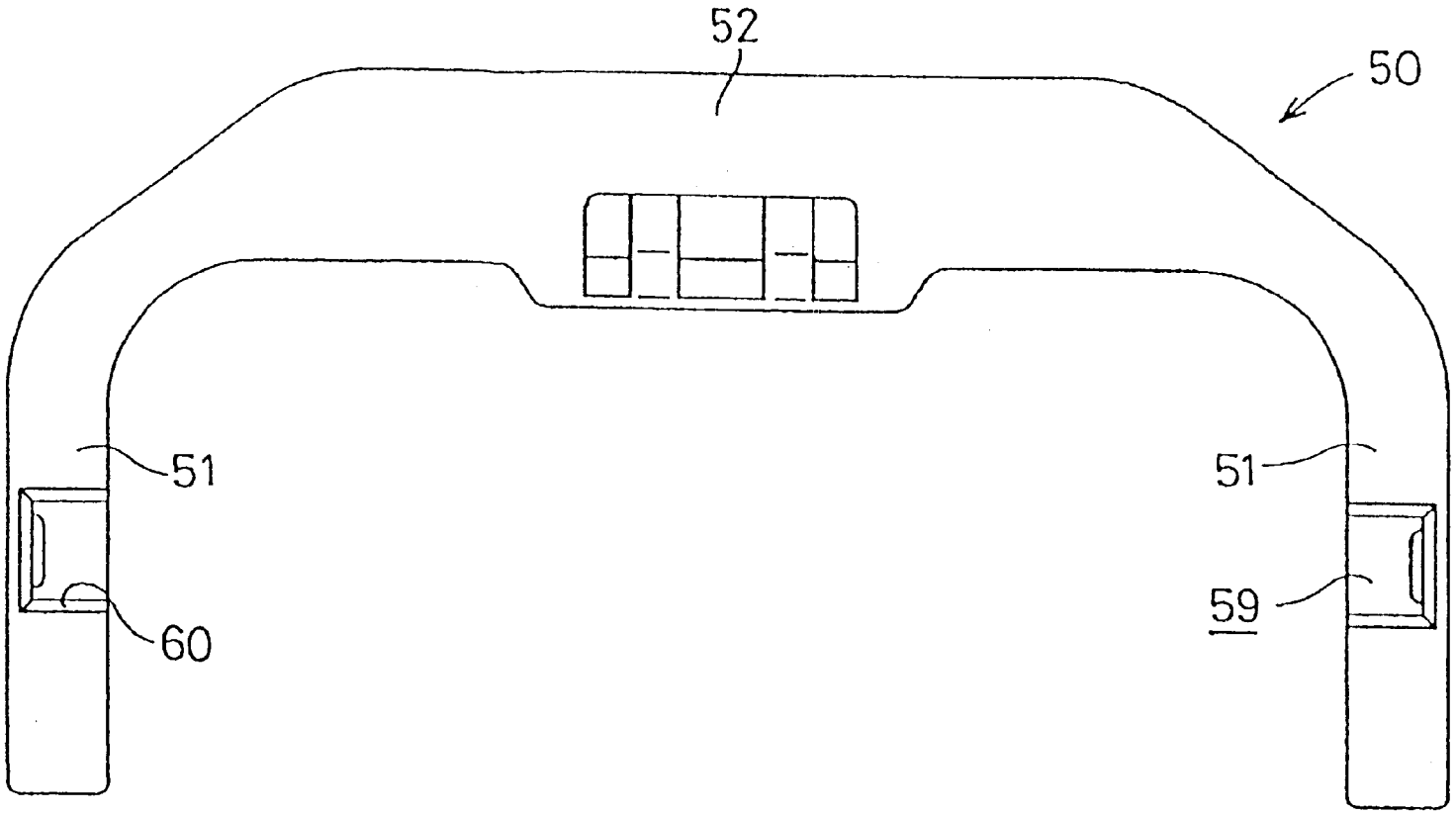
FIG. 6 is a front view of a lever.
Figure 7:
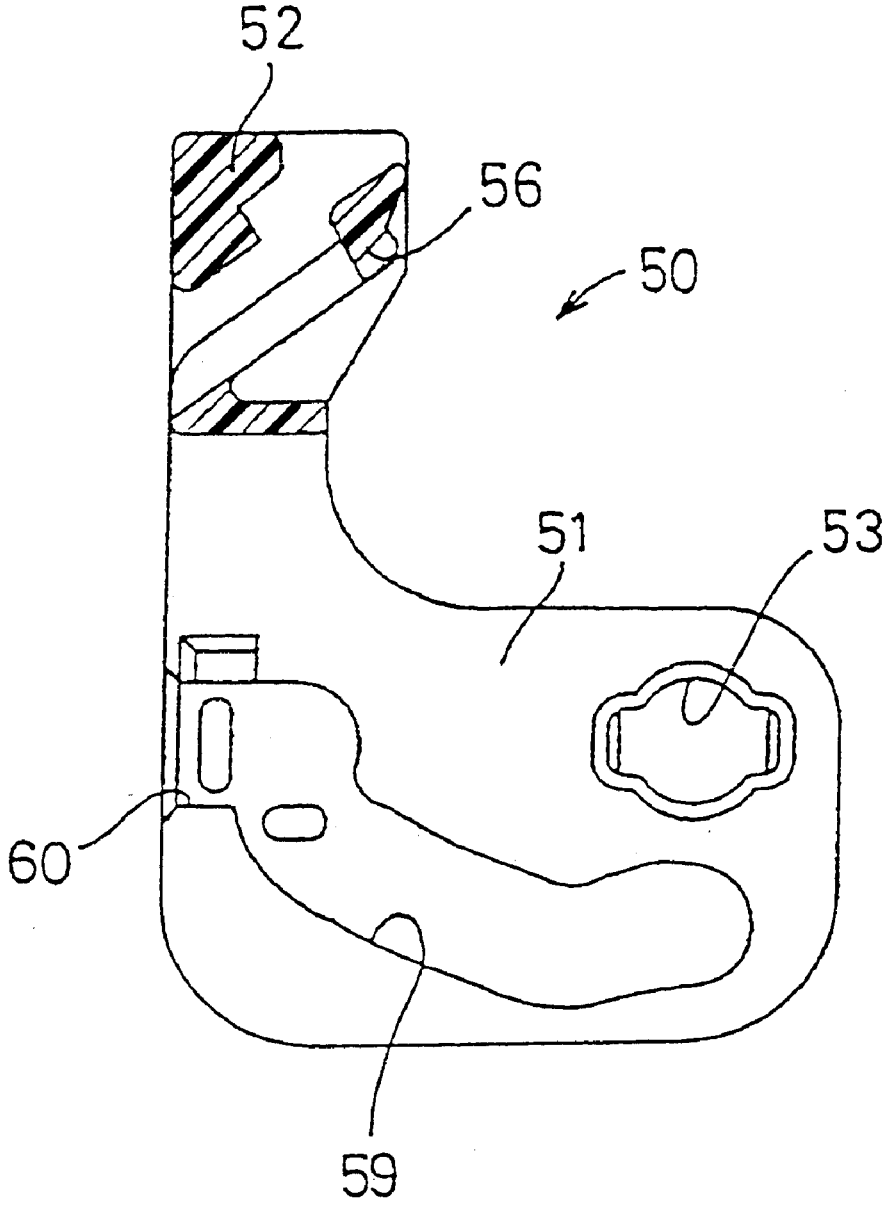
FIG. 7 is a section of the lever.

A lever 50 for assisting the connection of the male and female housings 40, 10 is mounted on the outer housing 12 of the female housing 10. As shown in FIGS. 6 and 7, the lever 50 is constructed by connecting the leading ends of a pair of substantially L-shaped arms 51 by an operable portion 52. The lever 50 is mounted such that the upper surface of the outer housing 12 is located between the arms 51, and is supported for rotation by fitting bearing holes 53 at the base ends of the arms 51 on shafts 54 that project from the left and right surfaces of the outer housing 12, as shown in FIGS. 3 and 4. More specifically, the lever 50 is rotatable preferably by 90° between a standby position, where the operable portion 52 is oriented substantially upward, as shown in FIG. 1, and a locking position, where the operable portion 52 is oriented substantially backward, as shown in FIG. 10. When the lever 50 is in its locked position, a locking portion 56 provided on the operable portion 52 is engaged with an engaging portion 57 that projects from the upper surface of the rear end of the outer housing 12 to lock the housings 10, 40 into each other.

Figure 9:
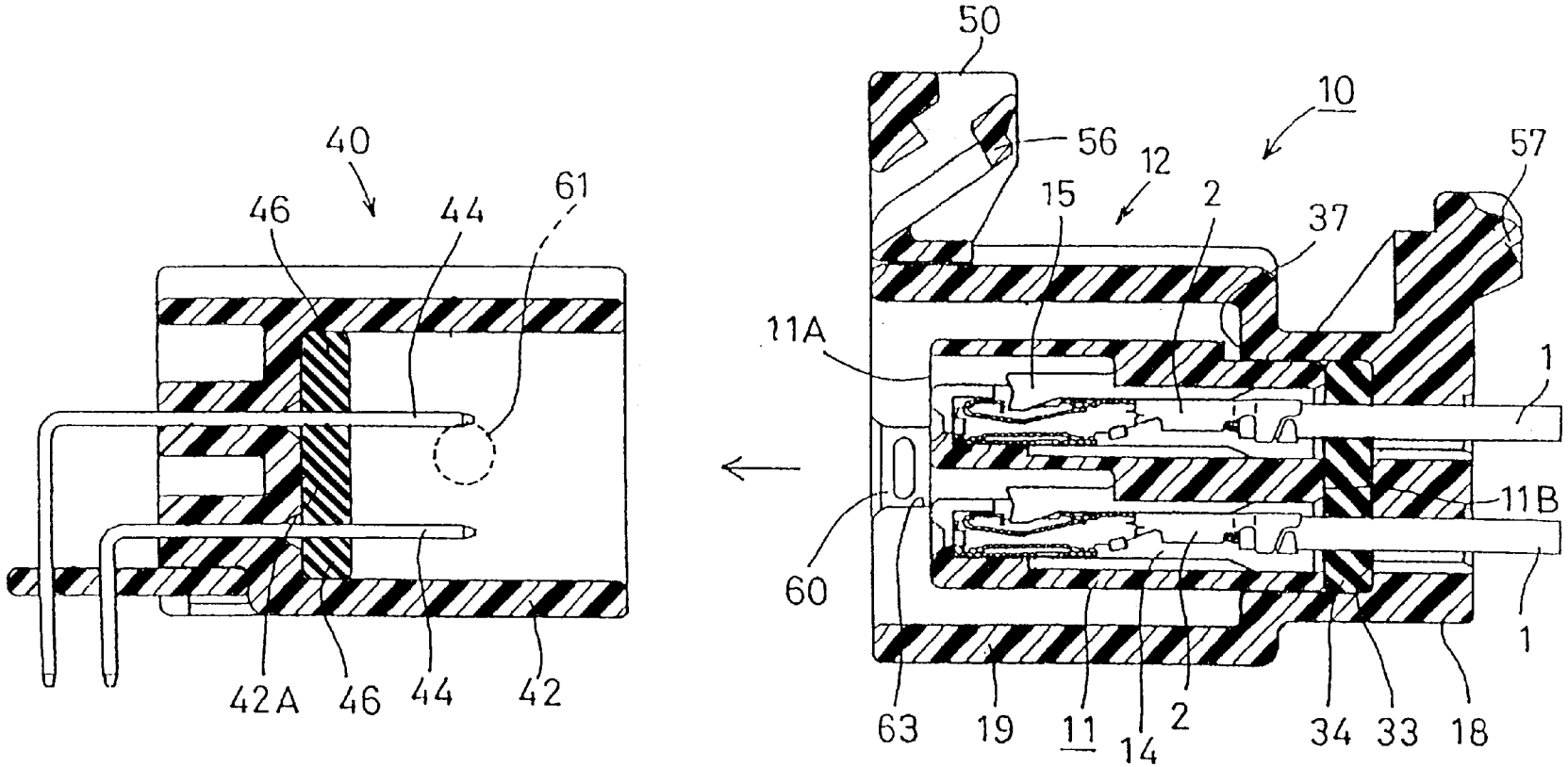
FIG. 9 is a vertical section of male and female housings before connection.

A cam groove 59 is formed in the inner surface of each arm 51 of the lever 50, as shown in FIG. 7. An entrance 60 to the cam groove 59 opens forward or in a connection direction when the lever 50 is located in its standby position. On the other hand, follower pins 61, as shown in FIGS. 5 and 9, project from the left and right surfaces of the male housing 40. Specifically, while the male and female housings 40, 10 are being connected; the follower pins 61 of the male housing 40 face the entrances 60 of the cam grooves 59. The cam grooves 59 have a radial distance from the pivotal center of the bearing holes 53 which varies depending on the azimuthal direction or angle, i.e. the distance becomes smaller when seen in azimuthal direction of rotation of the lever 50. Hence, a cam action is generated between the cam grooves 59 and the follower pins 61 in response to a rotation of the lever 50 toward the locking position. This cam action pulls the male and female housings 40, 10 toward each other for mating.

It should be noted that escape grooves 63 for the follower pins 61 are formed on the left and right surfaces of the outer housing 12 of the female housing 10.

The connector is assembled by first mounting the second gelatinous material 46 on the back surface 42A of the small receptacle 42 in the male housing 40. This positioning causes the second gelatinous material 46 to be penetrated by the male terminal fittings 44, as shown in FIG. 1. At this stage of assembly, the second gelatinous material 46 is almost in its natural state of compression.

Figure 8:
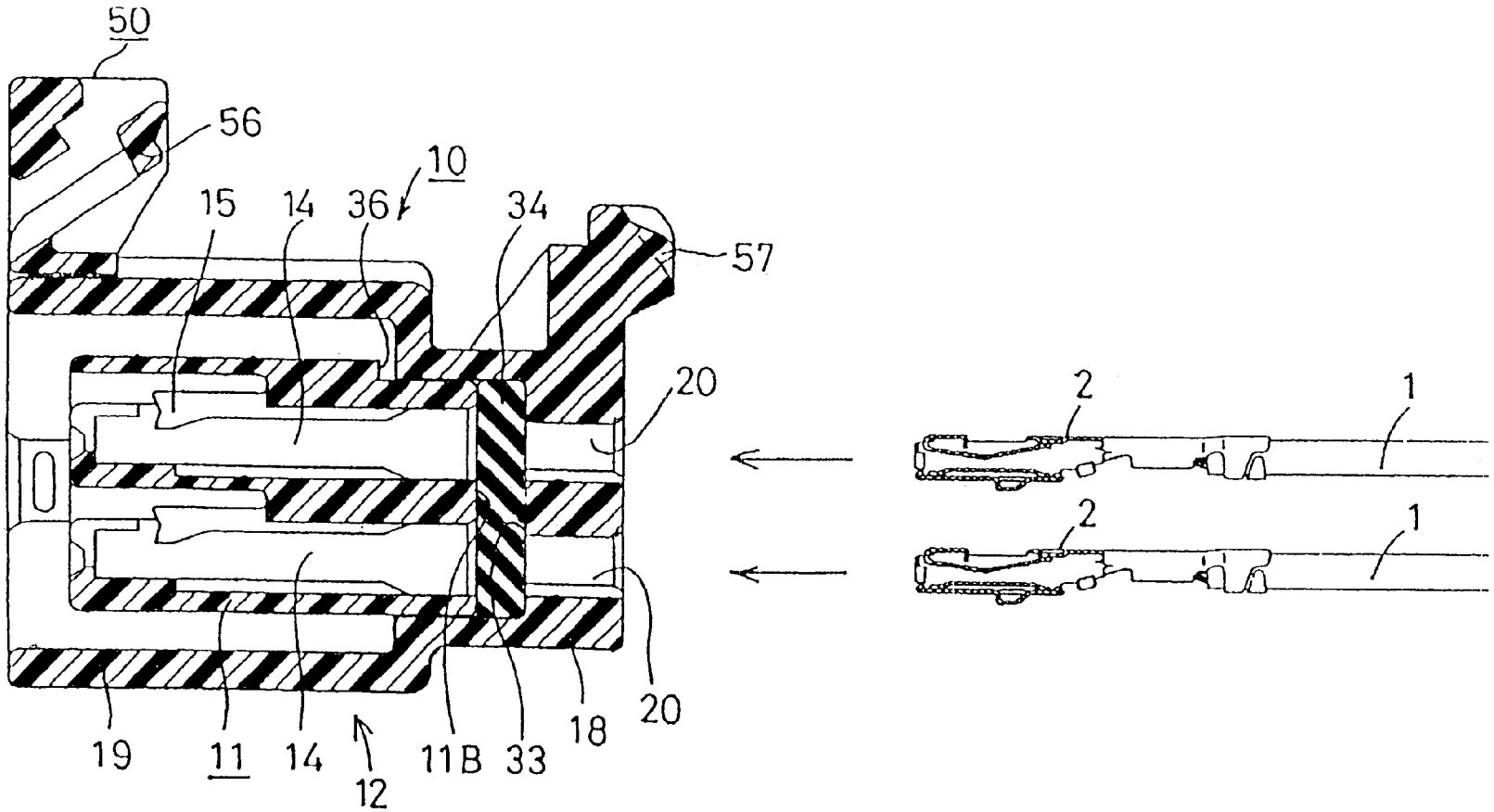
FIG. 8 is a vertical section showing an operation of inserting female terminal fittings.

The lever 50 of the female housing 10 is set in its standby position, and the first gelatinous material 34 is mounted on the front surface of the rear wall 18 of the outer housing 12. This positioning causes the first gelatinous material 34 to be penetrated by the guide plates 22. Subsequently, the inner housing 11 is inserted into the large receptacle 19 of the outer housing 12 from front while inserting the guide plates 22 into the guide holes 23. The inner housing 11 is held in its partly locked position by the engagement of the partial locking projections 25 with the front surfaces of the partial locking protuberances 30. At this time, the accommodation space 33 of the specified depth is defined between the rear surface 11B of the inner housing 11 and the rear wall 18 of the outer housing 12, as shown in FIG. 8. Thus, the first gelatinous material 34 is accommodated in the accommodation space 33 almost in its natural state of compression.

Next, as indicated by arrows in FIG. 8, the female terminal fittings 2, which have been secured to the ends of the wires 1, are inserted at least partly through the corresponding insertion openings 20 of the rear wall 18 of the outer housing 12. The female terminal fittings 2 penetrate through the first gelatinous material 34, and are locked by the locking portions 15 in the cavities 14. The first gelatinous material 34 is still almost in its natural state at this stage. Hence, the female terminal fittings 2 are subject to only a small resistance during this penetration through the first gelatinous material 34.

After all the female terminal fittings 2 are accommodated, the male and female housings 40, 10 are connected as indicated by an arrow in FIG. 9. During the connection, the follower pins 61 of the male housing 40 enter the entrances 60 of the cam grooves 59 of the lever 50. Subsequently, the lever 50 is rotated toward the locking position. This rotation causes the male housing 40 and the outer housing 12 of the female housing 10 to be pulled toward each other by the cam action of the cam grooves 59 and the follower pins 61.

As the connection proceeds, the front surface 11A of the inner housing 11 of the female housing 10 contacts the second gelatinous material 46, which then is compressed between the front surface 11A and the back surface 42A of the smaller receptacle 42 of the male housing 40, and the first gelatinous material 34 also is compressed. The inner housing 11 is pushed further into the outer housing 12 from its partly locked position.

As shown in FIG. 10, the connection is completed when the lever 50 is rotated to its locking position and locked there. At this stage, the first gelatinous material 34 is compressed to have a thickness which preferably is substantially half its initial thickness, and the inner housing 11 is held in its fully locked position by the engagement of the full locking projections 26 with the front surfaces of the full locking protuberances 31. In this way, the first gelatinous material 34 is adhered to the outer surfaces of the wires 1 drawn from the cavities 14 to seal the rear surface of the female housing 10.

On the other hand, the second gelatinous material 46 also is compressed between the back surface 42A of the smaller receptacle 42 of the male housing 40 and the front surface 11A of the inner housing 11 of the female housing 10 so that its thickness is reduced to preferably about half its initial thickness. As a result, sealing is provided between the male and female housings 40 and 10. More specifically, sealing is provided between the inner housing 11 and the smaller receptacle 42, around the male terminal fittings 44, and between the respective cavities 14 formed in the inner housing 11.

As described above, the second gelatinous material 46 is compressed between the back surface 42A of the smaller receptacle 42 of the male housing 40 and the front surface 11A of the inner housing 11 of the female housing 10 when the male and female housings 40, 10 are connected. Therefore, water protection is provided between the housings 10 and 40 and between the respective cavities 14 in the inner housing 11.

More specifically, a problem of water protection can be coped with merely by providing a space for the second gelatinous material 46 between the back surface 42A of the smaller receptacle 42 and the front surface 11A of the inner housing 11. Such a space does not complicate the construction of the connector housing.

Further, since the slight force that is required to compress the second gelatinous material 46 is exerted only at the final stage of the connection of the male and female housings 40, 10, a connection force required to connect the housings 10, 40 can also be reduced. In addition, since the second gelatinous material 46 can be compressed using the operative force of the lever 50, the connection force can be reduced further.

Figure 11:
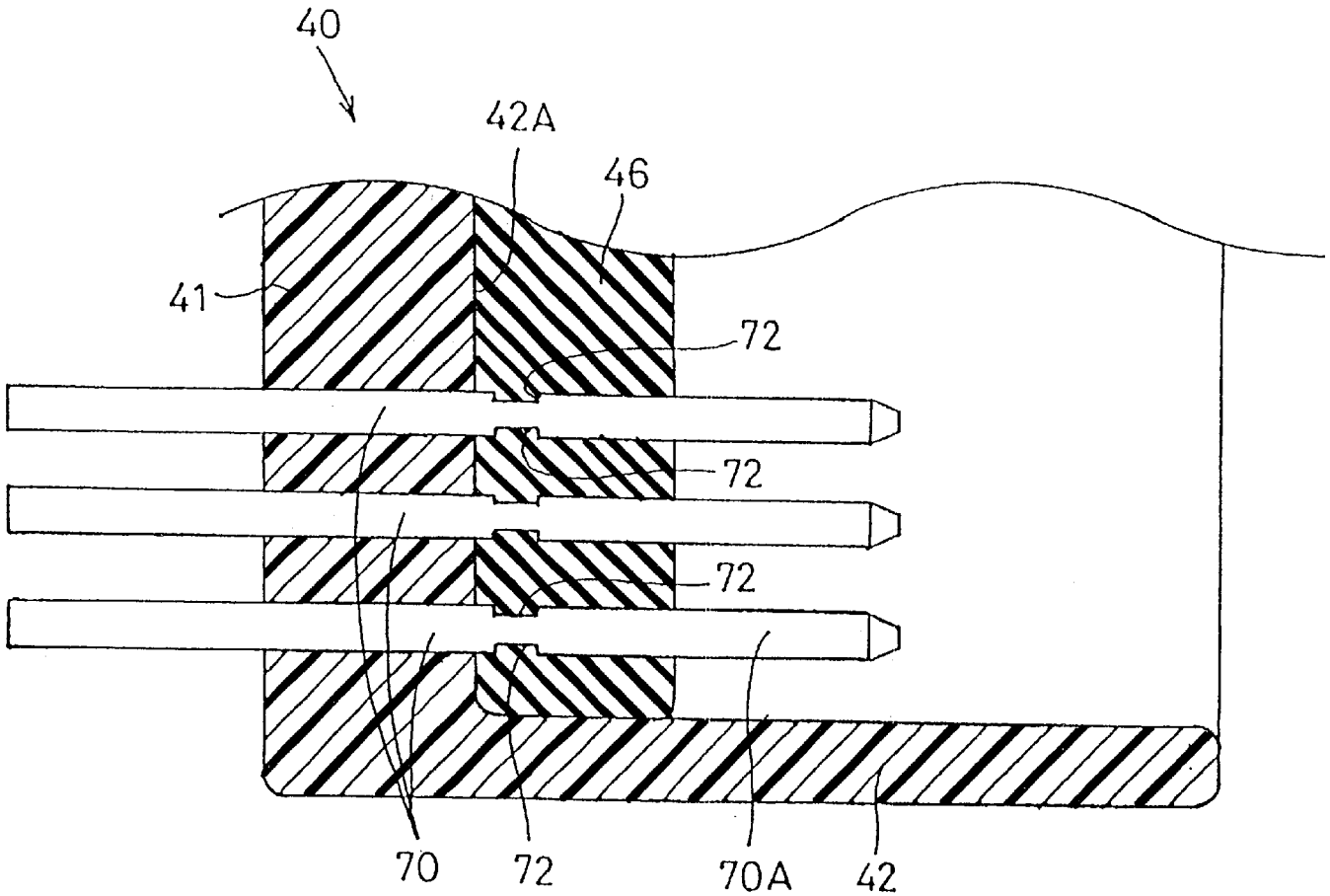
FIG. 11 is a partial section showing a mounting construction for a second gelatinous material according to a second embodiment of the invention.

FIG. 11 shows a second embodiment of the invention. In the second embodiment, second or male terminal fittings 70 that are mounted in the male housing 40 have a different shape. Specifically, recesses 72 are formed at the left and right sides of base portions of horizontal portions 70A of the male terminal fittings 70 that project from the back surface of the smaller receptacle 42. Since the other construction is the same as the first embodiment, no repetitive description is given, and parts that have the same or similar functions have been identified by the same or similar reference numerals.

As described above, the second gelatinous material 46 is mounted on the back surface 42A of the smaller receptacle 42 of the male housing 40, and is penetrated by the horizontal portions 70A of the male terminal fittings 70. Since the male terminal fittings 70 have the shapes described above, portions of the second gelatinous material 46 enter the recesses 72. This hooked engagement of the second gelatinous material 46 in the recesses 72 prevents displacement of the second gelatinous material 46 in the small receptacle 42 prior to the connection of the male housing 40 with the mating housing 10. Conversely, projections may be formed on the male terminal fitting to hook the second gelatinous material 46. It is also effective even if the recesses or projections are formed on only one side of the male terminal fittings.

The present invention is not limited to the above embodiments. For example, following embodiments are also embraced by the technical scope of the invention as defined in the claims. Besides these embodiments, various changes can be made without departing from the scope and spirit of the invention as defined in the claims.

Although the female housing is divided into two parts in the foregoing embodiments, the present invention is also applicable to watertight connectors having an integrally formed female housing.

An individual water-protecting means using rubber plugs fitted into the respective cavities or a collective water-protecting means using a single rubber plug may be adopted to seal the rear surface of the female housing.

The present invention is similarly applicable to watertight connectors of the type that has no lever and is merely connected by hand.

What is claimed is:

1. A watertight connector, comprising:

a first connector housing formed with an inner housing having opposite front and rear ends, a plurality of cavities extending between the ends for accommodating first terminal fittings, an outer housing having opposite front and rear ends, a rear wall being formed at the rear end of the outer housing, a first receptacle extending into the front end of the outer housing and an accommodation space extending from the first receptacle to the rear wall of the outer housing, the accommodation space being cross-sectionally smaller than the first receptacle, the rear end of the inner housing being mounted in the accommodation space in a partial lock position and being movable to a full lock position closer to the rear wall of the outer housing, the rear wall of the outer housing having openings aligned respectively with the cavities in the inner housing;

a first gelatinous seal disposed in the accommodation space between the rear wall of the outer housing and the inner housing, the first gelatinous seal covering the openings in the rear wall and being in a non-compressed state when the inner housing is in said partial look position;

a second connector housing having opposite front and rear ends, a peripheral wall extending rearwardly from the front end of the second connector housing and defining a second receptacle into which the inner housing of the first connector housing is at least partly fittable, the peripheral wall of the second connector housing further being mounted over the inner housing of the first connector housing and within the first receptacle, second terminal fittings being accommodated in the second connector housing and projecting into the second receptacle, the second terminal fittings being connected with the first terminal fittings when the Inner housing of the first connector housing is fit in the second receptacle; and a second gelatinous seal compressed between a back surface of the second receptacle and the front end of the inner housing of the first connector housing whereby the first and second seals prevent intrusion of water adjacent the terminals and into the watertight connector.

2. A watertight connector according to claim 1, wherein a lever provided with a cam portion is pivotally mounted on one of the first and second connector housings and a follower is provided on the other of the first and second connector housings at a location for engagement with the cam, the connection of the two connector housings being at least assisted by a pivotal operation of the lever.

3. A watertight connector according to claim 1, wherein the second gelatinous seal is mounted in the second receptacle in advance of connecting the housings and is penetrated by the second terminal fittings.

4. A watertight connector according to claim 1, wherein the second terminal fittings each are formed with at least one hooking portion for hooking the second gelatinous seal to substantially prevent the second gelatinous seal from coming out of the second receptacle.

5. A watertight connector according to claim 1, wherein the second gelatinous seal is compressable to between 30% and 70% of its longitudinal extension.

6. A watertight connector according to claim 1, wherein the second gelatinous seal is dimensioned to seal the plurality of cavities individually with respect to each other upon being compressed between the first and second connector housings.

7. A watertight connector according to claim 1, wherein the first gelatinous seal defines a selected thickness when the inner housing of the first connector housing is in the partial locked position, the first gelatinous seal being compressed to substantially have its initial thickness when the inner housing is moved to the full lock position, such that said gelatinous seal is urged into sealing engagement with wires projecting from the first terminal fittings.

8. A watertight connector according to claim 1, wherein the first connector housing (10) comprises an outer housing (12) and an inner housing (11), the outer housing (10) having a receptacle (19), the inner housing (11) being mounted in the receptacle (19) of the outer housing (12), the seal (46) being between a front surface (11A) of the inner housing (11) and a back surface (42A) of the receptacle (42) of the second connector housing (40).

9. A watertight connector according to claim 8, wherein a second seal (34) is arranged in an accommodation space (33) defined between a rear surface (11B) of the inner housing (11) and a rear wall (18) of the outer housing (12).

10. A watertight connector according to claim 9, wherein the second seal (34) is made of a gelatinous material.

11. A watertight connector according to claim 10, wherein the second seal (36) is compressable between the rear surface (11B) of the inner housing (11) and the rear wall (18) of the outer housing (12).

12. A watertight connector according to claim 11, wherein the second seal (36) is not compressed, when the inner and outer housings (11, 12) are positioned in a partial lock position (FIG. 8), while being compressed in a full locked position (FIG. 10) thereof.

13. A watertight connector according to claim 12, wherein the second seal (36) is penetrated by the first terminal fittings (2) in the partial lock position (FIG. 8) of the inner and outer housings (11, 12).

14. A watertight connector housing comprising:

an outer housing with opposite front and rear ends, a rear wall being formed at the rear end of the outer housing and being formed with a plurality of openings therethrough, a receptacle extending Into the front end of the outer housing and an accommodation space extending from the receptacle to the rear wall of the outer housing, the accommodation space being cross-sectionally smaller than the receptacle;

a plate-shaped gelatinous seal disposed in the accommodation space and adjacent the rear wall of the outer housing, such that the gelatinous seal covers the openings in the rear wall, the gelatinous seal, in an uncompressed state, defining a selected thickness;

an inner housing having opposite front and rear ends and a plurality of cavities extending therethrough, the rear end of the inner housing being engaged in the accommodation space of the outer housing in a partial lock position such that the cavities align respectively with the openings in the rear wall of the outer housing and such that the rear end of the inner housing is spaced from the rear wall of the outer housing by a first distance substantially equal to the thickness of the gelatinous seal, the inner housing being selectively movable rearwardly in the outer housing to a full lock position such that the rear end of the inner housing is spaced from the rear wall of the outer housing a second selected distance that is less than the first selected distance, whereby terminal fittings with wires connected thereto are selectively insertable through the openings in the rear wall of the outer housing, through the gelatinous seal and into the cavities of the inner housing while the inner housing is in the partial lock position, and whereby the inner housing subsequently is movable to the full lock position for compressing the gelatinous seal and achieving tight sealing against portions of the wires in the accommodation space.

15. The connector housing of claim 14, wherein the second selected distance is approximately one-half the first selected distance.

* * * * *